US010865523B2

(12) United States Patent
Kinnunen-Raudaskoski et al.

(10) Patent No.: US 10,865,523 B2
(45) Date of Patent: Dec. 15, 2020

(54) METHOD OF PRODUCING A FIBROUS WEB CONTAINING NATURAL AND SYNTHETIC FIBRES

(71) Applicant: Paptic Ltd, Espoo (FI)

(72) Inventors: Karita Kinnunen-Raudaskoski, Espoo (FI); Esa Torniainen, Espoo (FI); Tuomas Mustonen, Espoo (FI); Marja Juvonen, Espoo (FI)

(73) Assignee: Paptic Ltd, Espoo (FI)

( * ) Notice: Subject to any disclaimer, the term of this patent is extended or adjusted under 35 U.S.C. 154(b) by 135 days.

(21) Appl. No.: 16/087,693

(22) PCT Filed: Mar. 24, 2017

(86) PCT No.: PCT/FI2017/050210
§ 371 (c)(1),
(2) Date: Sep. 24, 2018

(87) PCT Pub. No.: WO2017/162927
PCT Pub. Date: Sep. 28, 2017

(65) Prior Publication Data

US 2019/0106842 A1 Apr. 11, 2019

(30) Foreign Application Priority Data

Mar. 24, 2016 (FI) ..... 20165259

(51) Int. Cl.

| | |
|---|---|
| ***D21H 13/24*** | (2006.01) |
| ***D21H 13/26*** | (2006.01) |
| ***D21H 17/28*** | (2006.01) |
| ***D21H 23/26*** | (2006.01) |
| ***D21H 13/36*** | (2006.01) |
| ***D21H 17/34*** | (2006.01) |
| ***D21H 13/10*** | (2006.01) |
| ***D21H 13/50*** | (2006.01) |
| *D21H 17/35* | (2006.01) |
| *D21H 17/37* | (2006.01) |

(52) U.S. Cl.
CPC ..... *D21H 13/24* (2013.01); *D21H 13/10* (2013.01); *D21H 13/26* (2013.01); *D21H 13/36* (2013.01); *D21H 13/50* (2013.01); *D21H 17/28* (2013.01); *D21H 17/34* (2013.01); *D21H 23/26* (2013.01); *D21H 17/35* (2013.01); *D21H 17/37* (2013.01)

(58) Field of Classification Search
USPC ..... 162/146
See application file for complete search history.

(56) References Cited

U.S. PATENT DOCUMENTS

| | | | | |
|---|---|---|---|---|
| 4,081,318 | A | 3/1978 | Wietsma | |
| 4,184,914 | A | 1/1980 | Jenkins | |
| 4,597,831 | A | 7/1986 | Anderson | |
| 5,009,747 | A | 4/1991 | Viazmensky et al. | |
| 5,204,165 | A | 4/1993 | Schortmann | |
| 5,753,071 | A * | 5/1998 | Spencer | B01D 29/21 156/446 |
| 5,840,787 | A | 11/1998 | West et al. | |
| 6,562,193 | B1 | 5/2003 | Elonen et al. | |
| 2003/0220039 | A1 | 11/2003 | Chen et al. | |
| 2007/0271889 | A1 | 11/2007 | Jaffee | |
| 2010/0173138 | A1 | 7/2010 | Williams et al. | |
| 2011/0293851 | A1* | 12/2011 | Bollstrom | H01L 51/0097 427/536 |
| 2014/0311694 | A1 | 10/2014 | Clark et al. | |

FOREIGN PATENT DOCUMENTS

| | | | |
|---|---|---|---|
| EP | 0889151 | A1 | 1/1999 |
| FI | 63806 | B | 4/1983 |
| JP | 3351916 | B2 | 12/2002 |
| JP | 20100235720 | A | 10/2010 |
| WO | WO9832906 | A1 | 7/1998 |
| WO | WO2011087438 | A1 | 7/2011 |

* cited by examiner

*Primary Examiner* — Mark Halpern
(74) *Attorney, Agent, or Firm* — Laine IP Oy

(57) ABSTRACT

The present invention relates to a method of manufacturing a fibre web which includes a fibre matrix that is comprised of natural fibres and possibly synthetic fibres. According to the present method, an aqueous, planar fibre layer is prepared from the natural fibres and possible synthetic fibres, which layer comprises an aqueous phase and a fibrous phase, and which layer is dried in order to remove the aqueous phase, in which case the natural fibres and possible synthetic fibres together form a fibre matrix. According to the present invention, binder is applied onto the water-containing fibre layer, which binder is allowed to penetrate via the aqueous phase at least partially in between the fibres, before the hydrogen bonds between the fibres form. With the present invention, it is possible to manufacture such cellulose or lignocellulose-based fibre products which have plastic-like properties, such as good fracture toughness, tear resistance and stretching.

20 Claims, 3 Drawing Sheets

METHOD OF PRODUCING A FIBROUS WEB CONTAINING NATURAL AND SYNTHETIC FIBRES

Figure 1:
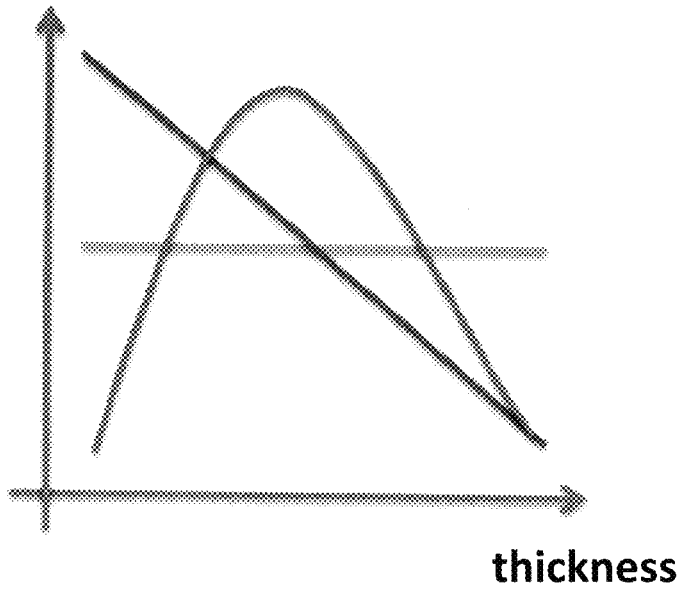

This application is a 371 of PCT/FI2017/050210 filed 24 Mar. 2017

The present invention relates to a method of manufacturing a fibre web comprising a fibre matrix that is formed by natural fibres and possibly synthetic fibres, according to the preamble of claim 1.

According to a method of the present kind, an aqueous, planar fibre layer is provided from natural fibres and synthetic fibres, which layer comprises an aqueous phase and a fibrous phase, and the fibre layer is dried in order to remove the aqueous phase, whereby the natural fibres and the synthetic fibres together form a fibre matrix.

The present invention also relates to a fibre web which comprises natural fibres and possibly synthetic fibres, according to claim 22.

It has long been a major challenge to manufacture, using paper-making processes, a fibre web which has plastic-like properties The reason for this is the difficulty of integrating the plastic-like components, for example synthetic plastic fibres and binders, into the structure.

Here, the "plastic-like" or "similar to plastic" properties mean that the fibre structure is stretchable and, at the same time, it has processing and operating properties, such as heat sealability, fracture toughness and tear resistance. Most suitably, the fibre structure also has good water resistance.

Obtaining plastic-like properties has been aimed at in fibre webs, besides by using traditional creping methods, also for example by mechanical treatment of the fibre webs. The Fibreform-cardboard of the BillerudKorsnäs manufacturer is one example of the application of these techniques, likewise the laminating or coating of the fibre web during the processing stage (for example, extrusion coating).

By layering fibre webs with plastic, for example by extrusion coating, the aim has also been to generate plastic-like properties, but these methods do not provide stretching and the methods require a separate process.

Furthermore, according to a known technique, the paper is passed through two rollers moving at different speeds, and is micro-creped. This results in a paper which stretches in one direction, i.e. in the direction of the machine, but the stretching is only plastic or mechanical, and the method does not provide a tough structure, in particular not fracture toughness. The investment costs of the equipment needed to implement the solution are high.

Examples of techniques used to generate stretchability are presented in the application publication WO 2011087438.

Adhesive material can be used either at the wet end or the dry end of the paper machine, or to increase the resistance of cardboard against wetting and against penetration of liquids, in particular aqueous liquids, and thus to provide a cellulosic material which possesses some degree of water repellency, as described in the FI Patent No. 63806. However, this process does not generate a stretchable fibre material.

Binder treatment has also been used to form non-woven structures, but in these structures the percentage of pulp fibres has typically been substantially less than half of the dry matter, and thus, for example, the importance of moisture for the applying of the binder and for generating the stretching has been minor, because of the amount of the synthetic components of the web. In addition, because of the low percentage of pulp fibre contained in the non-woven structure, the importance of the moisture for the prevention of the natural process of binding is insignificant compared to what takes place in our invention.

Definitions of the non-woven products are described in the ISO standard 9092 and the CEN EN standard 29092. Typically, the non-woven products comprise at least 50% of synthetic fibres and other non-plant-based fibres, the length/thickness ratio of which is greater than 300, or they comprise at least 30% of synthetic fibres, the length/thickness ratio of which is greater than 600, and the maximum density (virtual) is 0.40 g/cm$^3$).

In the past, the aim has also been to manufacture plastic-like fibre structures by adding binders, such as latex, directly into the pulp slush, before the headbox. This method most often causes, among others, precipitation and fouling problems, as well as a lot of binder is consumed for other purposes than interbonding of the fibres. The addition of the latex into the fibre slush complicates the controllability of the fibre product process, because the latex causes accumulation problems.

The prior art is further described in the publications JP 2010235720 A, JP 3351916 B2; U.S. Pat. No. 5,009,747, US 2010/173138, U.S. Pat. No. 6,562,193, US 2003/220039 and U.S. Pat. No. 4,184,914.

With the known structures, which are mainly comprised of natural fibres, such as cellulose fibres, it has not been possible to generate stretching, and particularly, high fracture toughness, and other plastic-like properties (heat-sealability). In addition, treatment/coating/covering carried out in the processing stage requires a separate process and the costs are higher.

It is an aim of the present invention to eliminate at least some of the problems associated with the prior art and to provide a new type of fibre web, which comprises natural fibres and synthetic fibres and which has plastic-like properties.

In the present invention, it has unexpectedly been found that by incorporation of the binder treatment into a selected part of the production that is carried out in conjunction with the wet process (paper machine), it is possible for the binder to settle in the bonding points of the fibres in the fibre web. It has been found that moisture prevents the forming of hydrogen bonds in the web. A particular feature of the invention is the use of the moisture/water that is naturally present in the web for allowing settling of the binder once it is brought to the web and before these bonds are formed.

More specifically, the method according to the present invention is mainly characterized by what is stated in the characterizing part of claim 1.

The product according to the present invention is, in turn, characterized by what is stated in the characterization part of claim 22.

Considerable advantages are obtained by means of the present invention. Thus, by treating a weakly bonded fibre web, which comprises natural fibres, such as chemical or mechanical pulp fibres and synthetic fibres, a desired structure is obtained. Typically, the elongation of the structure in the direction of the machine is typically at least 5%, for example approximately 5-20%, for example 8-15%, and in the cross-direction at least 5%, for example 5-30%, preferably 10-20%, and the structure has good tear resistance properties, fracture toughness and heat sealability. The tear index values in the direction of the machine are typically at least 10 mNm$^2$/g, for example 15-18 mNm$^2$/g, and in the cross-direction at least 15 mNm$^2$/g, for example 20-27 mNm$^2$/g. The fracture toughness values of the structure are, in the direction of the machine and in the cross-direction at least 20 Jm/kg, for example 37-54 Jm/kg.

Preferably, the structure is formed by giving a binder treatment to a moist web, at a dry matter content (DMC) of approximately 20-45%. Typically, the web that mainly comprises pulp fibres has this dry matter content within the areal entity that is formed of the webbing and drying sections of the paper machine, but in particular before the structure is completely dried. The moisture makes the web very receptive to the binder, and the moisture also prevents the formation of hydrogen bonds between the pulp fibres, and thus enables the binder to be placed between the fibres, including the pulp fibres, throughout the entire fibre structure. Thus, high stretchability, and in particular good mechanical properties that are required in the end use, such as tear resistance and fracture toughness, are obtained.

In one preferred embodiment, the fibre layer/web treatment is carried out by foam coating, which allows for an even application of the binder, a good uniformity in the thickness direction, and substantial use of the binder of the dry matter. In addition, the foam coating provides the possibility of using large particle-sized additives in the coating, such as synthetic fibres and particles.

The present invention allows for an efficient way of producing such new fibre products which have plastic-like properties. Examples of these are good fracture toughness, tear resistance and stretching.

Furthermore, with the present method, it is possible to flexibly functionalise fibre webs, for example by the addition of functional additives to soften the web/to increase the elongation, or to improve the heat-sealing. In addition, the present method can be used, unlike previous technologies, to treat the entire web uniformly in the thickness direction, or by means of adjustment, to a desired treatment gradient.

In the following, the preferred embodiments of the present invention will be examined more closely on the basis of the accompanying drawings.

Figure 2:
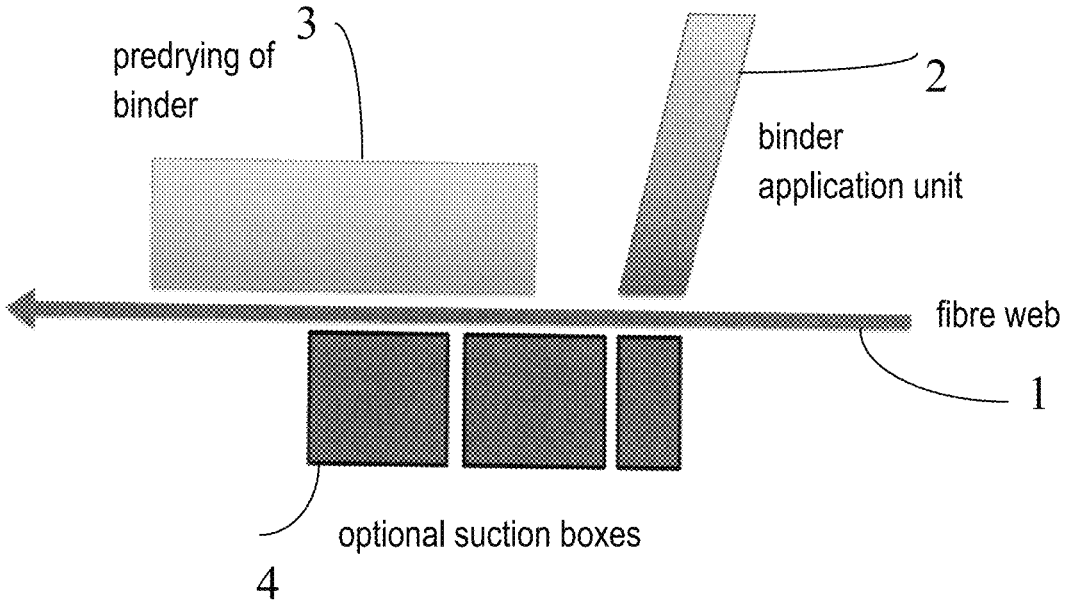
Figure 3:
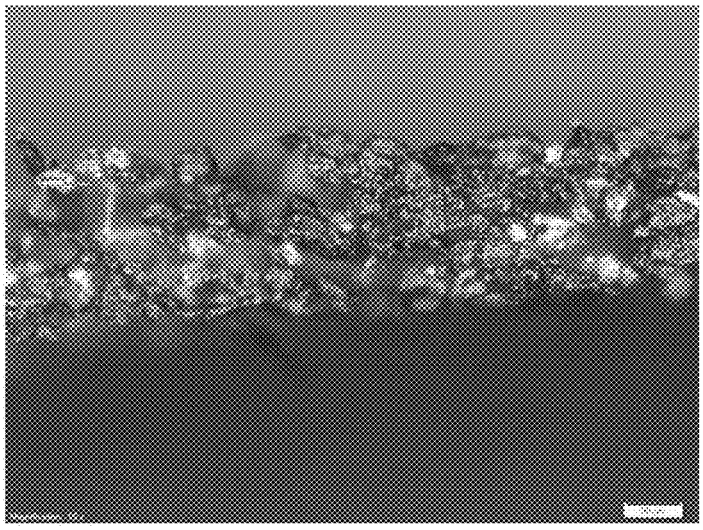
Figure 4:
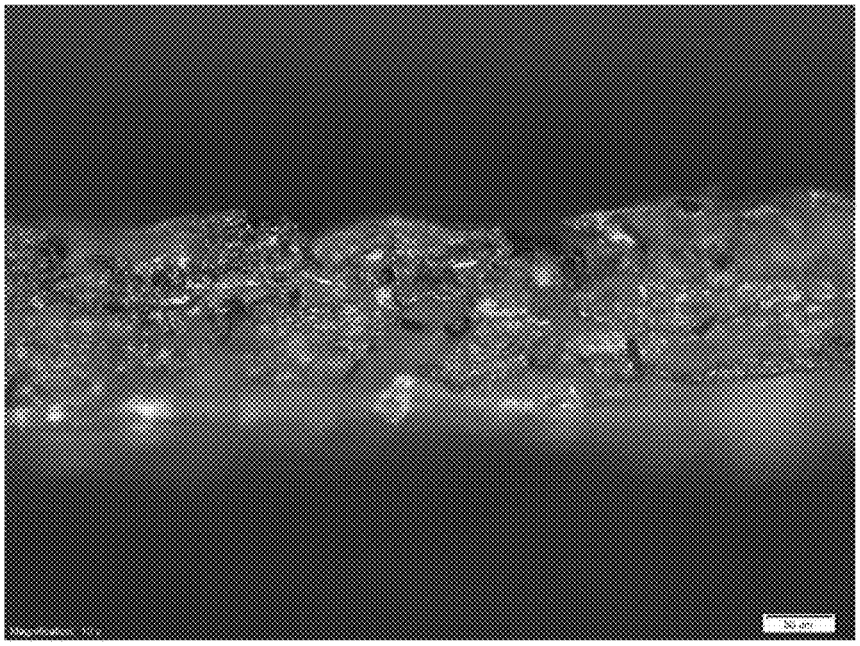
Figure 5:
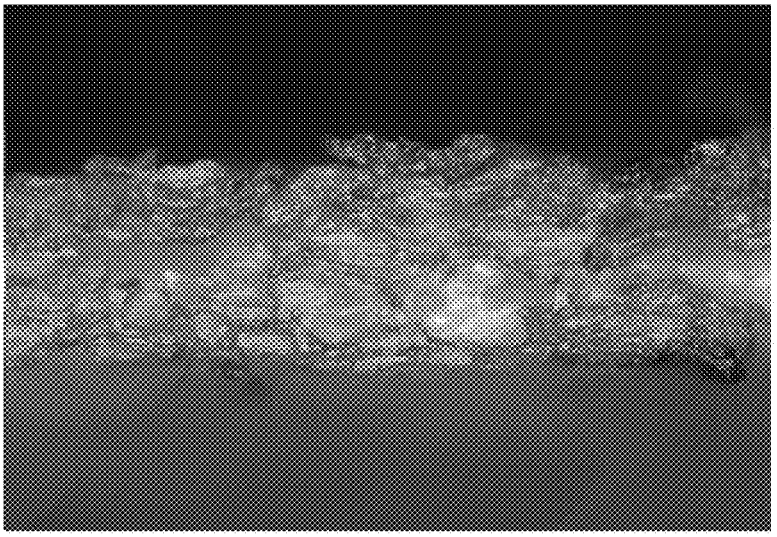

FIG. 1 shows a diagram of different treatment profiles in the thickness direction, FIG. 2 shows a basic diagram of the binder applying unit, FIGS. 3 and 4 show microscopic images of the cross-sections of latex coated sheets, which show the distribution of the latex in the cross-direction of the sheet, and FIG. 5 is a microscopic image of the z-directional distribution of $CaCO_3$, in a sheet which is coated with latex that comprises calcium carbonate.

Here, the above-mentioned term "application" means distribution and in general, bringing the binder onto the surface of the fibre layer. "Application unit" and "distribution units" are used interchangeably.

As will appear from the above, the present technology relates to a method of producing such a fibre web which comprises natural fibres and synthetic fibres and which fibres together form the fibre matrix of the fibre web. In order to improve the bonding between the fibres of such a fibre matrix, the fibre matrix also comprises a binder.

In a preferred embodiment, an aqueous, planar fibre layer is first formed from natural fibres and synthetic fibres, which layer comprises an aqueous phase and a fibre phase, after which the fibre layer is dried in order to remove the aqueous phase, whereby the natural fibres and the synthetic fibres together form a fibre matrix. A binder is incorporated into the fibre web by applying it onto top of, i.e. on the surface of, the water-containing fibre layer, and by allowing the binder to penetrate via the aqueous phase at least partially in between the fibres, before the fibre matrix forms.

It has been found that the aqueous phase of the fibre layer makes the fibre layer very receptive to the binder, and the moisture, i.e. the water, also prevents the formation of hydrogen bonds between the natural fibres, such as cellulose or lignocellulose fibres. In this case, it is possible to make the binder penetrate in between the cellulose fibres. When the fibre layer is dried and the water is removed from the fibre matrix, a high stretchability is achieved, when the binder joins the natural fibres to each other.

In one embodiment, the aqueous phase contained in the undried web is allowed to transport the binder, which is brought onto its surface, inside the web in such a way that, when the web dries, the material is bonded to the fibres thereby strengthening the web. In this case, the binder, which is applied onto the fibre layer, does not remain on the surface of the layer, instead, it penetrates via the aqueous phase in between the fibres before the hydrogen bonds between the fibres are formed.

In one embodiment, the binder is applied onto top of the water-containing fibre layer, when the solids content of this layer is at maximum two thirds of the weight of the fibre layer.

Typically, the dry matter content of the fibre layer is approximately 10-65%, for example approximately 20-55%, especially approximately 25-45%. The percentages are calculated from the total weight of the fibre layer.

In one embodiment, it is possible to make the binder penetrate, in the z-direction of the fibre layer, from the application surface to a depth which is least 50%, especially at least 70%, of the total thickness of the fibre layer, and, preferably, at least part of the binder can be made to penetrate through the fibre layer all the way to the opposite surface of the layer.

FIG. 1 shows an example of a binder concentration gradient.

Advantageously, the binder is applied onto the top of the water-containing fibre layer by means of a contactless application method. This is particularly suitable for the above-mentioned dry matter percentages.

Examples of suitable application methods are foam coating, spray coating, and curtain coating, foam coating being particularly preferred.

The binder can be applied onto the fibre layer at one or at several points. Thus, in one embodiment, it is possible to arrange 2-5 sequential coating points in order to apply the binder onto the fibre layer. The fibre layer can be dried between the application runs.

In an embodiment, the binder is applied in the form of an aqueous solution or an aqueous dispersion. By using water as a carrier for the binder, it is possible to improve the penetration of the binder into the fibre matrix to be formed, in between the fibres, especially the natural fibres.

In one embodiment, the composition of the binder which is brought to the fibre layer is such that its water content is at maximum the same as, preferably lower than, the water content of the fibre layer at that application point.

Typically, the fibre web is planar and it comprises two opposite planar surfaces, the binder being applied onto at least one of its planar surfaces. However, it is also possible to apply the binder to both sides, or, if there are several sequential application points, as described below, the binder can be brought at one point only to one surface and at another application point to both sides of the fibre layer.

It is possible to facilitate the penetration of the binder into the fibre web, during the application or immediately thereafter, by directing a suction to the binder from the opposite side of the fibre web.

Thus, in one preferred embodiment, in order to improve the uniformity in the thickness direction, suction is used during the treatment, particularly below the coater and in the section subsequent to the coater.

One application solution is described in FIG. 2. As it shows, binder is applied onto the surface of the fibre layer 1, in the application unit 2. The binder is dried by means of the drying units 3. These can be, for example, radiant heaters or hot air blowers. In order to facilitate the absorption of the binder, it is possible to arrange suction boxes 4, on the side opposite to the application unit.

In this case, it is more preferable to use a wire to carry the fibre web (before drying). A paper and cardboard embodiment is described in more detail below.

FIGS. 3 and 4 (see also Example 2) show how the latex penetrates through a coated sheet. FIG. 3 shows a sample into which latex is brought, and FIG. 4 shows a corresponding sample which comprises latex.

Into the binder it is possible to add substances which are capable of modifying the properties of the fibre web, such as synthetic fibres or plasticisers, such as sorbitol or glycerol, or similar polyols, or fine material, such as cellulose-based fine material or nano-cellulose.

It is also possible to bring additives to the fibre web by means of or together with the binder, with which additives it is possible to improve the mechanical and thermal properties of the fibre web, such as heat-sealability, stretchability, air permeability, printability, thermal conductivity, water vapour permeability, absorption characteristics and friction.

By means of or together with the binder, it is also possible to bring other components, such as pigments and fillers, and hydrophobic sizes, such as ASA (alkyl succinic anhydride) or AKD (alkyl ketene dimer), and other typical additives used in papermaking.

The fibres used in the materials according to the present invention, may be plant-based, i.e. natural fibres, synthetic fibres, and mixtures and combinations thereof.

Natural fibres are typically cellulose or lignocellulose fibres. In particular, the fibres are sourced from cellulose or lignocellulose raw materials, for example, by using chemical or semi-chemical pulping or defibering. The fibres can also be mechanical pulp fibres or recycled fibres.

In general, the natural, i.e. plant-based fibres, which are used in the present invention, can be comprised of or sourced from chemical pulp, such as sulphate or sulphite pulp, organosolv pulp, recycled fibres and mechanical pulp, which is produced, for example, by refining or by grinding. Examples of such masses are: refiner mechanical pulp, i.e. RMP, and pressurised refiner mechanical pulp, i.e. PRMP, pre-treatment refiner chemical alkaline peroxide mechanical pulp, i.e. P-RC APMP, thermomechanical pulp, i.e. TMP, thermomechanical chemical pulp, i.e. TMCP, high-temperature TMP, i.e. HT-TMP, RTS-TMP, alkaline peroxide pulp (APP), alkaline peroxide mechanical pulp (APMP), alkaline peroxide thermomechanical pulp (APTMP), Thermopulp, groundwood pulp (groundwood pulp, i.e. GW, or stone groundwood, i.e. SGW), pressurised groundwood pulp, i.e. PGW, as well as super pressure groundwood pulp, i.e. PGW-S, thermo groundwood pulp, i.e. TGW, or thermo stone groundwood pulp, i.e. TSGW, chemimechanical pulp, i.e. CMP, chemirefiner mechanical pulp, i.e. CRMP, chemithermomechanical pulp, i.e. CTMP, high-temperature chemithermomechanical pulp, i.e. HT-CTMP, sulphite-modified thermomechanical pulp (SMTMP), and reject CTMP, groundwood CTMP, semichemical pulp, i.e. SC, neutral sulphite, semi-chemical pulp (NSSC), high-yield sulphite pulp, i.e. HYS, biomechanical pulp, i.e. BRMP and the pulps which are produced with the OPCO process, blasting-cooking process, Bi-Vis process, dilution water sulphonation process, i.e. DWS, sulphnonated long fibres process, i.e. SLF, chemically treated long fibres process, i.e. CTLF, long fibre CMP process (LFCMP), sulphate wood pulp, mdf fibres, nanocellulose, cellulose fibres having an average particle size of less than 1000 nm, and modificates and mixtures thereof.

The pulp can be bleached or unbleached. The pulp can be sourced from hardwood or softwood. Examples of wood species are birch, beech, aspen such as the European aspen, poplar, alder, eucalyptus, maple, acacia, mixed tropical hardwood, pine, American spruce, hemlock, larch, European spruce, such as the Black Spruce or Norway Spruce, recycled fibre, as well as waste streams and secondary flows, which comprise fibres and which originate from the food industry or the wood and paper industry, as well as mixtures thereof.

It is also possible to use raw materials which are neither wood nor wood-containing, such as seed hair fibres, leaf fibres, bast fibres. Plant fibres can be sourced from, for example, cereal crop straws, wheat straw, reed canary grass, reed, flax, hemp, kenaf, jute, ramie, sisal, abaca, seeds, coir, bamboo, bagasse, cotton kapok, milkweed, pineapple, cotton, rice, cane, esparto grass, *Phalaris arundinacea*, and combinations thereof.

In one embodiment, the fibre web is produced by using essentially unground cellulose or lignocellulose fibres. The freeness of semi-chemical and mechanical fibres is at least 300 ml/min, for example more than 450 and preferably more than 600 ml/min and, correspondingly, the Schopper-Riegler number of chemical fibres is less than 35, for example under 25, preferably under 20.

In particular, the synthetic fibres are thermoplastic polymer fibres, such as polylactide, glycolic acid polymer, polyolefin, polyethylene terephthalate, polyester, polyamide, polyvinyl alcohol or bicomponent (bico) fibres. Examples of other fibres are regenerated cellulose fibres such as viscose, Lyocell, rayon, and Tencel fibres, and for example, carbon and glass fibres. Most suitably, polyolefin, polyester, polylactide or bico fibres or mixtures thereof, are used.

The fibre length is typically 3-100 mm, for example 5-40 mm and preferably 5-20 mm. The fibres typically have a thickness of 0.9-7 dtex, preferably 1.2-3.5 dtex.

Examples of the binders are natural binders and biopolymers, such as starch and starch modificates and derivatives, chitosans, alginates, and synthetic binders, for example latexes, such as vinyl acetate and acrylate latex and polyurethanes and SB latexes and mixtures thereof, and various copolymers, especially copolymers of synthetic binder polymers. Also, polyvinyl alcohol and polyvinyl acetate can be used.

The binder, such as latex, can be brought to the surface of the fibre layer in the form of binder foam. The air content of the foam is more than 50%, for example approximately 65-95%, such as 80-95%.

In one embodiment, the percentage of natural fibres is at least 50 parts by weight, and of synthetic fibres at maximum 50 parts by weight. Most suitably, the percentage of natural fibres is approximately 60-95 parts by weight, especially 70-90 parts by weight, and of synthetic fibres 5-50 parts by weight, especially 10-30 parts by weight.

The grammage of the fibre web may vary widely and typically is approximately 10-200 g/m$^2$, especially approximately 20-150 g/m$^2$.

A sufficient amount of binder is added to ensure that its percentage of the dry weight of the dried fibre web is 5-40%, preferably approximately 10-30%. A dried fibre web is generated, the stretching of which in the direction of the machine is typically at least 5%, for example approximately 5-20%, for example 8-15%, and in the cross-direction, at least 5%, for example 5-30%, preferably 10-20%.

In one embodiment, the fibre web is prepared at a paper or cardboard machine. In such an embodiment, a fibre suspension is formed of natural fibres and synthetic fibres, this fibre suspension is webbed to a smooth fibre layer, and this fibre layer is dried in order to prepare the fibre web.

Typically, binder is applied onto the fibre layer when the solids content of the fibre layer is approximately 20-50%. In particular, the binder is applied onto the fibre layer when this layer is, for example, in a free draw or supported, in which case the binder is brought to the fibre layer at a point which is located within the areal entity that is formed of the webbing and drying sections of the paper machine.

Also in the paper and cardboard machine solution, after the application of the binder, the binder is dried, for example by directing most suitably heating onto the fibre layer, as shown in FIG. 2.

The fibre web can be prepared by using a conventional webbing technique, but according to a more preferred embodiment, the fibre web is prepared by using foam webbing. In this respect, reference is made to FI Patent Application No. 20146033.

Based on the above, practical experiments were performed.

A material comprising natural fibres and synthetic fibres was produced into a web by foam forming of a fibre pulp which comprised, by weight, 70-90% pulp (bleached softwood sulphate pulp) and 10-30% synthetic fibres (for example PP, PET BiCo). A fibre web was obtained, the weight of which was 20-100 g/m$^2$. Typically, the average length of the fibres was 0.5-100 mm.

The fibre web was treated with a binder when the dry matter percentage of the web was 20-45%. This percentage of dry matter was obtained between the wire and the drying sections of the paper machine.

In a comparative test, in which the fibre web was prepared in accordance with FI Application No. 20146033, a base web was obtained, the tensile strength of which was lower than 1 kN/m and the elongation lower than 5%. The base web did not comprise a binder.

The binder treatment was carried out by using foam coating, by adding approximately 5-40% of a binder, preferably approximately 10-30%.

The binders used were vinyl acetate and acrylate latex, which were applied at a dry matter percentage of approximately 20-50%. After the binder treatment, the elongation of the fibre web in the machine direction is typically at least 5%, for example approximately 5-20%, for example 8-15%, and in the cross-direction at least 5%, for example 5-30%, preferably 10-20%.

The following examples illustrate the embodiments.

Methods:

Elongation measurements were carried out according to the standard EN ISO 1924-2: 2008.

Example 1. Comparison of the Coated Samples

Handsheets were prepared in laboratory conditions using foam webbing, from the above-mentioned materials.

The sheets were coated with a latex dispersion by using vacuum assisted foam coating, both before and after the drying of the base sheet. After the coating, the samples were dried in an oven for a period of 10 minutes. In the last step of the sheet production, the sheet was calendered with a laboratory calender. The grammage of the sheets thus obtained was 50 g/m$^2$ and the amounts of latex were 12% (wet-coated) and 14% (dry-coated).

The properties of the dried coated samples are shown in Table 1, where the tensile strengths of a wet base sheet and, respectively, of a dried base sheet, are given. The measurement conditions were as follows: 25% RH, T=24° C.

TABLE 1

Tensile strengths of laboratory sheets which were prepared by using foam and then coated

| Sample name | Tensile strength kN/m | Stretching % | Breaking energy J/m$^2$ | Extension stiffness kN/m |
|---|---|---|---|---|
| Dry base sheet | 1.02 | 7.1 | 40.2 | 34.3 |
| Wet base sheet | 1.45 | 8.3 | 66.1 | 38.5 |

The measurements were not carried out under standardised conditions, but the purpose was merely to show the difference between the dry sheet and the wet sheet.

Example 2. Distribution of the Latex—a Sample Prepared in a Pilot Unit

A microscopic image was taken of the samples prepared in a pilot unit, which samples were prepared by coating the bottom web with a latex, in accordance with the present technology, and which image shows the distribution of the latex in the z-direction of the web.

FIGS. 3 and 4 show the microscopic images. Only minor staining of the pulp fibres was observed in the samples having a high latex content (24%), which indicates that the latex was evenly distributed throughout the sample.

Example 3. Functionalisation of the Web—Addition of Filler

A bottom web that was prepared with a pilot scale foam webber was brought to the process of foam coating by using a laboratory scale coater. Calcium carbonate ($CaCO_3$) was added into the latex dispersion prior to coating.

FIG. 5 shows the z-directional distribution of the $CaCO_3$. The $CaCO_3$ particles are highlighted in red.

REFERENCES

WO 2011087438
FI 63806
JP 2010235720 A
JP 3351916 B2
U.S. Pat. No. 5,009,747
US 2010/173138
U.S. Pat. No. 6,562,193
US 2003/220039
U.S. Pat. No. 4,184,914

The invention claimed is:

1. A method of manufacturing a fibre web comprising a fibre matrix formed by natural fibres and optionally synthetic fibres, the method comprising:

providing a water-containing, planar fibre layer comprised of at least one of: natural fibres or a combination of natural and synthetic fibres, which layer comprises an aqueous phase and a fibrous phase, applying onto the water-containing, planar fibre layer a binder, which is allowed to penetrate via the aqueous phase at least partially in between the fibres before removing the aqueous phase from the fibre layer and before hydrogen bonds are formed between the fibres, and drying the fibre layer in order to remove the aqueous phase, whereby the natural fibres and possible synthetic fibres together form the fibre matrix, wherein the penetration of the binder into the fibre layer, during the application or immediately thereafter, is facilitated by directing suction to the binder from the opposite side of the fibre layer to which the binder is applied.

2. The method according to claim 1, wherein the binder is applied onto the water-containing fibre layer when the dry matter percentage of the fibre layer is 10-65%.

3. The method according to claim 1, wherein the binder is applied onto the water-containing fibre layer by a contactless application method.

4. The method according to claim 1, wherein the binder is applied by using foam coating, spray coating or curtain coating.

5. The method according to claim 1, wherein the binder is applied onto the water-containing fibre layer in the form of a solution or a gel, an aqueous solution, or an aqueous dispersion.

6. The method according to claim 1, wherein a sufficient amount of binder is added to ensure that its percentage of the dry weight of the dried fibre web is 5-40%.

7. The method according to claim 1, wherein the elongation of the dried fibre web in the machine direction is at least 5% and in the cross-direction at least 5%.

8. The method according to claim 1, wherein the fibre layer is planar and is comprised of two opposite planar surfaces, in which case the binder is applied onto at least one of its planar surfaces.

9. The method according to claim 1, wherein to the binder are added substances for modifying the properties of the fibre web selected from the group consisting of pigments, fine material or nano-cellulose, synthetic fibres or plasticisers.

10. The method according to claim 1, wherein to the fibre web are brought additives for improving the mechanical and thermal properties of the fibre web.

11. The method according to claim 1, wherein the natural fibres are cellulose or lignocellulose, and the optional synthetic fibres are thermoplastic polymer fibres selected from the group consisting of polylactide, glycolic acid polymer, polyolefin, polyamide, polyethylene terephthalate, polyester, polyvinyl alcohol, and bicomponent (bico) fibres, or are regenerated cellulose fibres selected from the group consisting of viscose, rayon, Lyocell, and Tencel fibres.

12. The method according to claim 1, wherein the binder is a natural binder or a biopolymer selected from the group consisting of starch or starch modificate or derivative, chitosan, alginate, a latex binder, polyvinyl alcohol or polyvinyl acetate, and mixtures and copolymers of these binders.

13. The method according to claim 1, wherein the latex is brought onto the surface of the fibre layer in the form of a binder foam, a latex percentage of which is 10-30% by weight.

14. The method according to claim 1, wherein the water-containing, planar fibre layer comprises a combination of natural and synthetic fibres, and wherein an amount of natural fibres is 70-90 parts by weight and the synthetic fibres 10-30 parts by weight, and a grammage of the fibre web is 20-200 $g/m^2$.

15. The method according to claim 14, wherein the web is formed at the paper machine and the binder is brought to the fibre layer at a point which is between the wire and the drying sections of the paper machine.

16. The method according to claim 1, wherein:

a fibre suspension is formed of the natural fibres and optional synthetic fibres, the fibre suspension is formed into a smooth fibre layer by web-formation, and the fibre layer is dried in order to prepare the fibre matrix, the binder being applied onto the fibre layer when the dry matter percentage of the fibre layer is 20-50%.

17. The method according to claim 1, wherein the fibre web is formed by using foam forming.

18. The method according to claim 1, wherein the binder penetrates, in the z-direction of the fibre layer, from the application surface to a depth which is least 50% of the total thickness of the fibre layer, and, preferably, at least part of the binder is made to penetrate through the fibre layer.

19. The method according to claim 1, wherein the natural fibres are cellulose or lignocellulose fibres, in particular, the natural fibres are fibres which are prepared from cellulose or lignocellulose raw materials, by using chemical or semi-chemical defibering, or they are fibres prepared by using mechanical defibering.

20. The method according to claim 19, wherein the natural fibres comprise unrefined cellulose or lignocellulose fibres, wherein a freeness of the semi-chemical and mechanical fibres is at least 300 ml/min and, correspondingly, a Schopper-Riegler number of the chemical fibres is less than 35.

* * * * *